United States Patent [19]

Katayama et al.

[11] 4,401,385

[45] Aug. 30, 1983

[54] IMAGE FORMING APPARATUS INCORPORATING THEREIN OZONE FILTERING MECHANISM

[75] Inventors: Hajime Katayama, Kawasaki; Tateki Nagaoka, Yokohama; Yusaku Takada, Tokyo; Shigeyoshi Onoda, Kawasaki; Atsushi Kubota, Komae; Hiroshi Hara, Tokyo; Masashi Suda, Iruma, all of Japan

[73] Assignee: Canon Kabushiki Kaisha, Tokyo, Japan

[21] Appl. No.: 384,640

[22] Filed: Jun. 3, 1982

Related U.S. Application Data

[63] Continuation of Ser. No. 167,344, Jul. 10, 1980, abandoned.

[30] Foreign Application Priority Data

Jul. 16, 1979 [JP] Japan ..... 54-91164

[51] Int. Cl.[3] ..... G03G 15/00

[52] U.S. Cl. ..... 355/15; 355/3 R; 355/3 DD; 355/14 D; 118/652

[58] Field of Search ..... 355/15, 3 DD, 3 CH, 355/14 CH, 3 R, 3 FU, 14 FU, 17, 3 SH; 55/6, 55/9,47;250/324, 325, 527, 538, 539, 540; 427/38, 427/39; 118/639, 652; 15/256.52

[56] References Cited

U.S. PATENT DOCUMENTS

| | | | |
|---|---|---|---|
| 2,777,957 | 1/1957 | Walkup | 250/325 |
| 2,836,725 | 5/1958 | Vyverberg | 250/49.5 |
| 3,666,363 | 5/1972 | Tanaka et al. | 355/17 |
| 3,675,096 | 7/1972 | Kiess | 317/262 A |
| 3,777,158 | 12/1973 | Kamogawa et al. | 250/324 |
| 3,914,046 | 10/1975 | Tanaka et al. | 355/15 |
| 4,071,361 | 1/1978 | Marushima | 96/1 |
| 4,095,980 | 6/1978 | Satomi | 15/256.52 |
| 4,154,521 | 5/1979 | Tanaka | 355/15 X |
| 4,260,235 | 4/1981 | Stack | 355/15 X |
| 4,364,660 | 12/1982 | Oda | 355/15 |

*Primary Examiner*—A. C. Prescott

*Attorney, Agent, or Firm*—Fitzpatrick, Cella, Harper & Scinto

[57] ABSTRACT

An ozone filtering mechanism in an image forming apparatus such as office copiers, etc. and its arrangement, wherein various component elements disposed in the image forming apparatus in such a manner that a flow path for a discharge current of ozone gas generated from a corona discharger and a flow path for heat current from a heat source such as a light source, etc. may be centralized at one place, thereby enabling a single ozone filter to be disposed at this portion of the centralized flow paths for perfect ozone filtration. Presence of the heat current at the time of the ozone filtration promotes adsorption and decomposition of ozone to augment the filtering effect to the maximum possible extent.

6 Claims, 24 Drawing Figures

IMAGE FORMING APPARATUS INCORPORATING THEREIN OZONE FILTERING MECHANISM

This is a continuation of application Ser. No. 167,344, filed July 10, 1980, now abandoned.

BACKGROUND OF THE INVENTION

1. Field of the Invention

This invention relates to a mechanism for prevention of temperature increase and ozone removal in an image forming apparatus.

2. Description of the Prior Arts

In recent years, development in the image forming apparatus such as a reproduction machine, etc. tends to be directed toward miniaturization and high-speed operation.

In reducing the size of the reproduction apparatus, it is requisite that every constituent unit of the apparatus be smaller and the apparatus as a whole be highly condensed. Problems which occur in such miniaturization and condensation are the temperature rise within the apparatus and the removal of zone to generate along with the use of corona dischargers. In particular, when a hologen lamp is used for image exposure or heat fixing it is effected by speed increase in operation, and the temperature rise is extreme, with the consequence that there arises various problems such as, in the case of a dry-type development reproduction apparatus, solidification of toner in the developer and cleaner, changes in development density, and change in performance of the photosensitive plate, and, in the case of a wet type development reproduction apparatus, evaporation of solvent due to the temperature rise, changes in development density, and so on. Ozone in its high concentration is harmful, restrictions to which have become more and more stringent.

In the case of a plain paper copier (P.P.C.), large numbers of corona dischargers are used for the latent image formation, image transfer, and so on, hence a large quantity of ozone is generated. For simple prevention of the temperature rise within the apparatus, it is sufficient to increase the quantity of discharging air. However, in the case of performing the ozone adsorption using an ozone filter, it is necessary that the contact time between ozone and activated carbon be prolonged, and the discharging quantity of air in proportion to a certain definite amount of the activated carbon be decreased to augment the adsorption efficiency thereof, or the discharging speed be lowered, or the quantity of the activated carbon be increased with respect to the certain definite discharging quantity of air. In a large-sized reproduction apparatus, it has so far been the practice to independently provide a blower to discharge a large quantity of air to prevent the temperature within the apparatus from rising, and another blower to discharge air containing therein highly concentrated ozone through an ozone filter.

On the contrary, in a small-sized reproduction apparatus, it is very difficult to perfectly segregate the ozone-containing-air and the cooling air. It is also difficult to provide the cooling blower and the ozone removing blower independent of each other from the standpoint of the capacity of the apparatus. Furthermore, it is difficult to provide an ozone filter with a sufficiently large area and capacity.

There is so far known the art of providing discharge openings in the shield plate of the corona discharger so as not to impinge ion wind containing ozone to the photosensitive paper (U.S. Pat. No. 3,777,158), and the art of providing a fan to cause the ozone-containing-air to pass through a catalytic substance (U.S. Pat. No. 3,675,096). However, there has not been known the concept of increasing the filtering effect by concentrating the ozone-containing-air and the heat current at one place in the apparatus.

SUMMARY OF THE INVENTION

It is therefore an object of the present invention to provide a device for efficiently adsorbing a large quantity of air containing therein ozone without splitting the air current for cooling and for ozone filtering in the reproduction apparatus.

It is another object of the present invention to provide a device of a construction, in which a flow path for discharge current of ozone gas and another flow path for heated current from a heat source are ultimately concentrated at one place in the image forming apparatus, and at which place the ozone filtering device is disposed to effectively utilize the pyrolytic function due to heating of the ozone gas, causing the filter to perform the ozone adsorbing function.

Other objects and features of the present invention will become more apparent from the following detailed description of the preferred embodiments of the invention, when read in conjunction with the accompanying drawings.

DETAILED DESCRIPTION OF PREFERRED EMBODIMENTS

Figure 1:
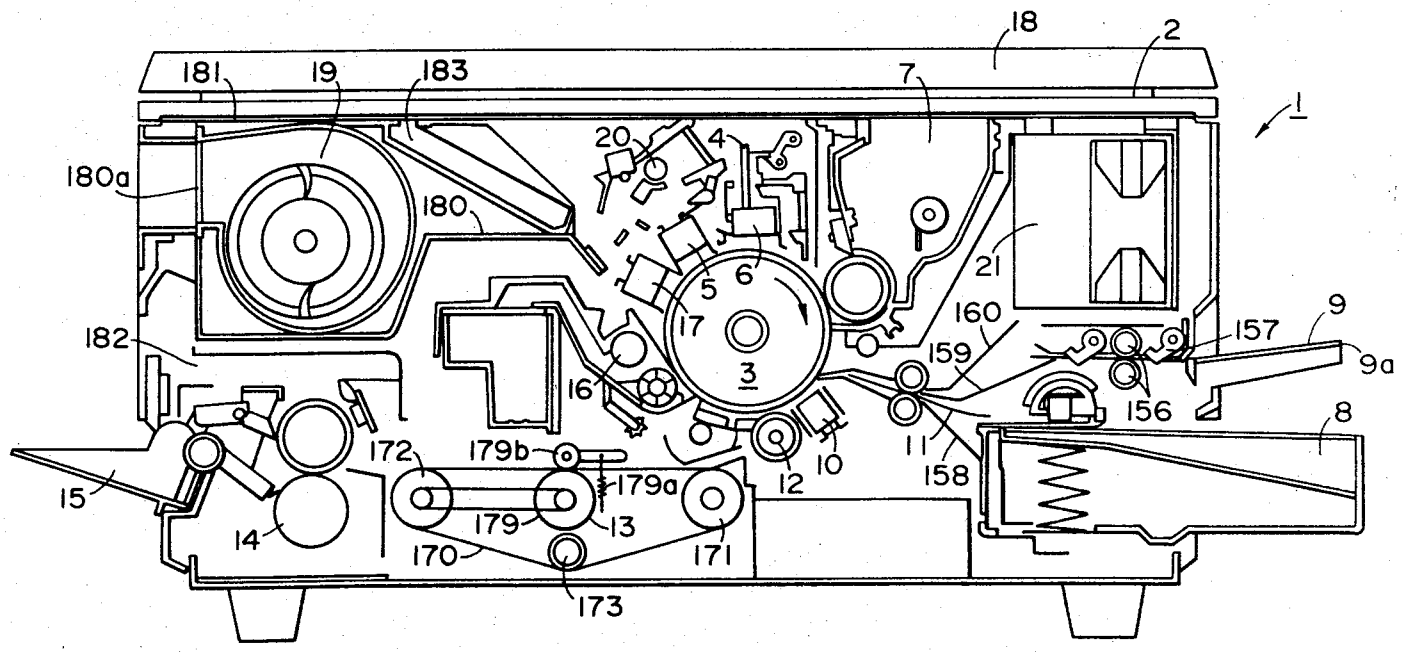
FIG. 1 is a side elevational view, in cross-section, showing an entire construction of one embodiment of an image forming apparatus according to the present invention.

Referring to FIG. 1, showing a cross-sectional view of the reproduction apparatus which is taken as an example of the image forming apparatus according to the present invention, reference numeral 2 designates an image original mounting table having the same length as that of the reproduction apparatus. This image original mounting table 2 is reciprocally provided on a guide rail installed on the upper main body 1 of the reproduction apparatus. The numeral 3 refers to a photosensitive drum having a photoconductive member on its peripheral surface. The photosensitive drum 3 is rotatably mounted on the upper main body 1, and rotates in the direction of the arrow. At a position immediately above the center of the photosensitive drum 3, there is provided a short focus image forming element array 4, which forms an original image placed on the above-mentioned image original mounting table 2 on the photosensitive drum 3.

The reference numeral 5 designates a primary charger which uniformly charges the photosensitive drum 3. The numeral 6 refers to a secondary charger which removes a charge with corona discharge of a polarity opposite to the charge polarity of the primary charger and simultaneously performs the image exposure from above the secondary charger through the above-mentioned short focus image forming element array 4. Then, a post-exposure is effected on the photosensitive drum 3, which has completed the image exposure, by leading a partially split light from a halogen lamp as the image exposure light source, thereby forming an electrostatic latent image on the drum. The electrostatic latent image is developed by a developing device 7. The development is effected by the jumping development with the use of a one-component magnetic toner as taught, for example, in U.S. patent application Ser. No. 58,434 and No. 58,435 by the same assignee-to-be of the present application. The toner image formed on the photosensitive drum 3 is transferred onto an image transfer paper 11 forwarded from a paper feeding cassette 8 or a manual paper insertion mechanism 9 by a corona discharge from an image transfer charger 10 of the same polarity as that of the primary charger 5. The image transfer paper 11, on which the toner image has been transferred is separated from the photosensitive drum 3 by cooperation of a separating roller 12 and a separating unit (to be described hereinafter), after which it is sent into an image fixing device 14 by means of a conveying section 13. The image fixing device 14 performs the image fixation by fuser rollers. After the image fixation, the image transfer paper is discharged into a paper receptacle 15 as a a final reproduced copy.

The photosensitive drum 3 after completion of the image transfer operation is subjected to removal of residual toner by a cleaner 16, is then rendered a uniform potential by a pre-charge remover 17, and proceeds to the primary charger 5. These operations as mentioned above are repeated in the case of multi-copy reproduction.

A numeral 18 refers to a pressing plate for an image original, 19 a heat discharging fan, 20 an exposure lamp, and 21 an air intake fan.

Figure 2:
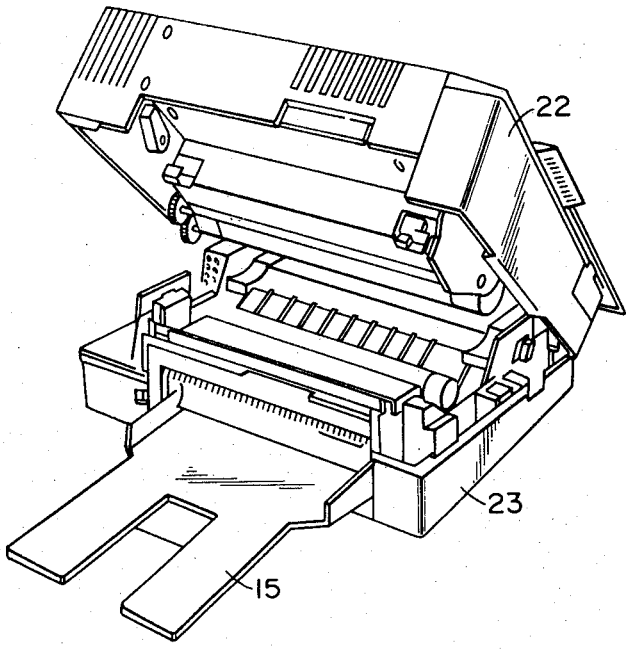
FIG. 2 is a perspective view of the image forming apparatus shown in FIG. 1 with its upper and lower section being opened.
Figure 3:
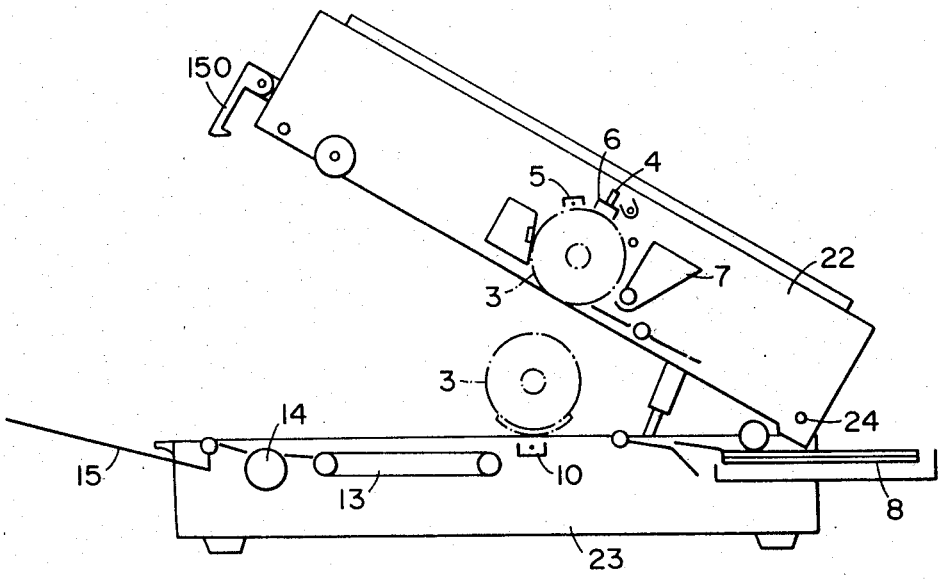
FIG. 3 is a schematic side elevational view of the apparatus shown in FIG. 2.

As shown in FIGS. 2 and 3, the reproduction apparatus is divided into an upper main body 22 including those component units relating to the image formation such as the photosensitive drum 3, the optical system 6, the developer 7, the cleaning section 16, and so on, which are arranged substantially along the moving path of the image transfer paper for the convenience of measures to be taken at the time of incomplete paper forwarding, maintenance and inspection of the apparatus, and cleaning of the same, and a lower main body 23 including those component units relating to the paper forwarding system such as the manual paper insertion section, the paper feeding cassette section, the image transfer section, the paper separating section, the paper conveying section, and the image fixing section. These upper and lower main bodies 22 and 23 are openable on the pivot of a pivotal shaft 24 at the right side of the reproduction apparatus as shown in FIGS. 2 and 3. By the above-described construction, it is possible to perfectly view the paper travelling path when the paper forwarding operation is out of order, and detect other troubles, and to take proper measures adapted to the situation.

Figure 4:
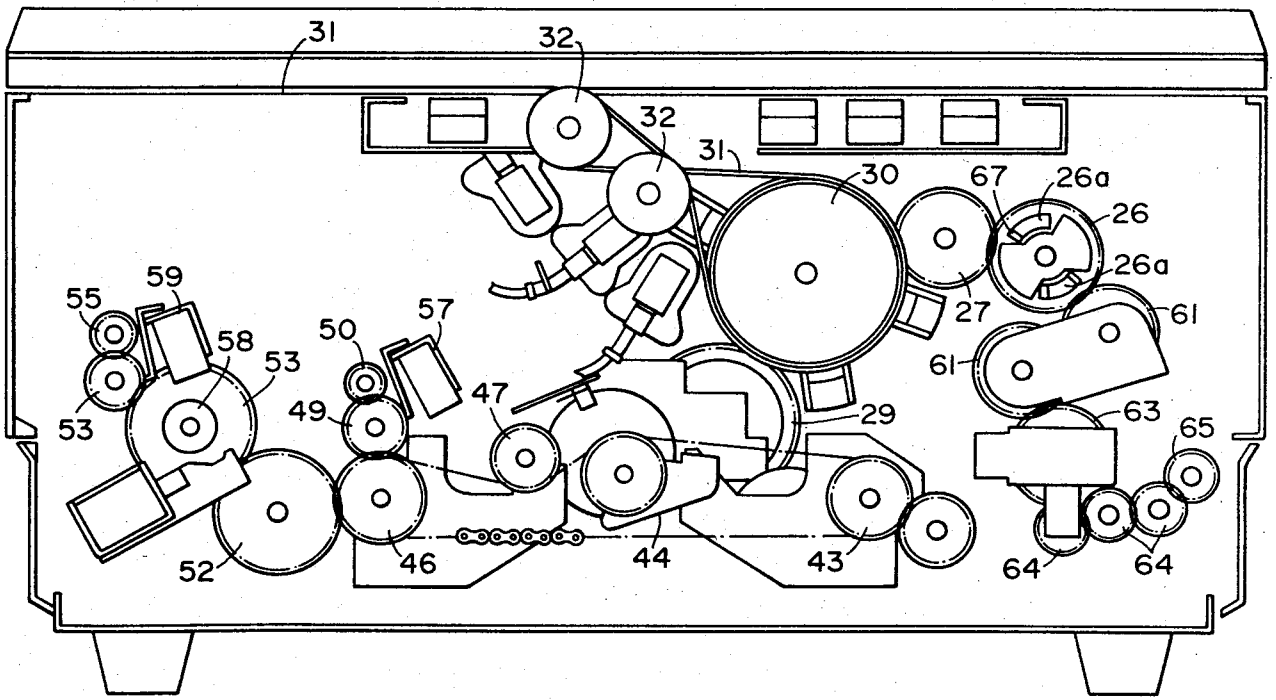
FIG. 4 is a front view showing a driving system of the apparatus shown in FIG. 1.
Figure 5:
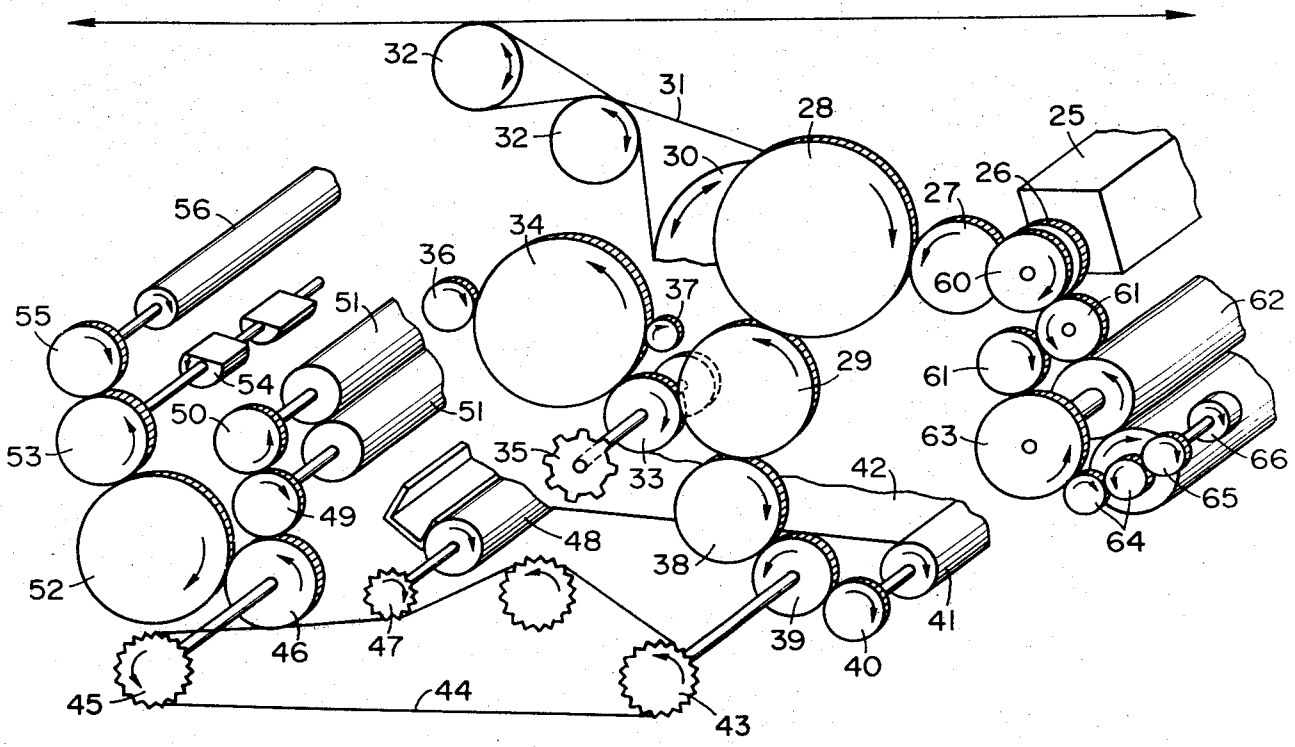
FIG. 5 is a schematic perspective view of the driving system shown in FIG. 4.

Referring now to FIGS. 4 and 5, explanations will be made as to the drive mechanism of the reproduction apparatus. There are two systems for the power transmission from a main motor 25: one is to drive the image original mounting table, the photosensitive drum, the paper conveying section, and the paper feeding section; and the other is to drive the image fixing section. The first system will now be described. The driving force from the main motor 25 is transmitted to a clutch gear 28 fixed on one end of a shaft of a pulley for reciprocating the image original mounting table through a gear 26 fixed on one end of the motor shaft and an intermediate gear 27, and is further transmitted to a branching gear 29. A pulley 30 is fixed on the other end of the clutch shaft, on which an image original mounting table driving wire 31 is wound for several winding turns. Both ends of the driving wire are guided by guide pulleys 32, 32 and fixed at both the front and rear ends of an angle constituting the image original mounting table. By forward and reverse rotations of the pulleys through change-over of the reciprocating clutch, the image original mounting table is reciprocally moved. The driving force is transmitted through the branching gear 29 in the direction of the photosensitive drum, and in the direction of conveyance of the image transfer paper and the paper feeding section. In the direction of the photosensitive drum section, the driving force is transmitted to an intermediate gear 33. The intermediate gear 33 is fixed on one end of a gear supporting shaft and meshed with a drum gear 34, and a pulse drum 35 for generating clock pulses is fixed on the other end of the shaft. The pulse drum 35 is so constructed that a large number of slits are formed on the outer circumference of a disc. By rotation of this pulse drum, light from a photo-interrupter (not shown) disposed between the slit section of the disc is intercepted and transmitted, thereby generating pulses. A gear 36 for driving the developer and a gear 37 for driving the cleaner are meshed with the drum gear 34, each operating to rotate the developer roller and cleaner roller (to be mentioned hereinafter). In the direction of the paper conveying and paper feeding sections, the driving force is transmitted to intermediate gears 38, 39. A conveying roller 41 is rotated by a conveying gear 40 meshed with the intermediate gear 39, whereby a belt 42 extended on the conveying roller 41 rotates accordingly. At the other end of a shaft supporting the intermediate gear 39, there is further fixed a sprocket wheel 43, and the driving force is further transmitted to a gear 46 through a chain 44 and another sprocket wheel 45. A paper separation roller 48 to separate the image transfer paper from the photosensitive drum is rotated by a sprocket wheel 47 engaged with the chain 44.

The gear 46 is meshed with timing gears 49, 50, and the driving force is transmitted to the timing rollers 51, 51 through a spring clutch 57. The gear 46 is further meshed with a gear 52, through which a paper feeding gear 53 is rotated. This rotation of the gear 53 is transmitted to a paper feeding roller 54 through a half-rotating spring clutch 58. A manual paper insertion gear 55 is meshed with the paper feeding gear 53, and the driving force is transmitted to a manual paper feeding roller 56 through a spring clutch 59. Both spring clutch 57 and half-rotating spring clutch 58 are rendered on and off by a signal generated by movement of the image original mounting table, and the spring clutch 59 is rendered on and off by a signal generated by manual paper inserting operation.

In the following, explanations will be given as to the image fixing system used in the reproduction apparatus according to the present invention. The driving force from the main motor 25 is transmitted to gears 60, 61 for driving the image fixing device through a gear 60. The image fixer driving gears 61, 61 are meshed with a gear 63 fixed at one end of an image fixing upper roller 62 to transmit the driving force to that roller. Further, the driving force is transmitted to a gear 65 fixed at one end of a paper discharging roller shaft 66 to drive the paper discharging roller through intermediate gears 64, 64.

As mentioned in the foregoing, the reproduction apparatus for use in the present invention can be divided into the upper and lower main body portions for improving various processing operations such as paper jam treatment, machine maintenance and repair, and so forth. Of the abovementioned driving system in this construction, the main motor, the image original mounting table, and the photosensitive drum section are disposed in the upper main body 22, while the paper conveying section, the paper feeding section, and the image fixing section are disposed in the lower main body 23. Because of such construction, the intermediate gears 33, 38 are free to moving toward the branching gear 29, and the image fixing roller driving gears 61, 61 are free to moving toward the image fixing upper roller gear 63. These two pairs of gears are arranged in such a direction that they may become meshed with their respective counterparts at the time of driving. At that time, a certain backlash must be secured between the gears, for which purpose the image fixing roller driving gear 61 and the image fixing upper roller gear 63 are mutually contacted by providing a drum at one end of the gear portion as shown in the drawing, and the backlash between the branching gear 29 and the intermediate gears 33, 38 is secured by mutually contacting a contact members at both sides of the gears. Incidentally, the gears 26, 60 of the main motor 25 are fixed in parallel at the end of the output shaft thereof. In this case, if both gears are fixedly provided, variations in a load such as shock in the image fixing section, etc. is directly transmitted to the image forming section to possibly cause blurring. In order therefore to avoid such image blurring, the reproduction apparatus according to the present invention is so constructed that, as shown in FIG. 4, the gear 26 alone is fixed, a projection **26*a* is provided on the lateral surface of the gear 26, a hole 60*a* is formed in the lateral side of the gear 60 so as to insert the projection 26*a* into the hole 60*a*, and an elastic member 67** is interposed between surfaces which are mutually contacted at the time of driving, thereby absorbing the shock to prevent the image blurring.

In the ensuing description of the preferred embodiment of the reproduction apparatus according to the present invention, each of the principal constituent units will be explained in detail.

Photosensitive Drum

Figure 6:
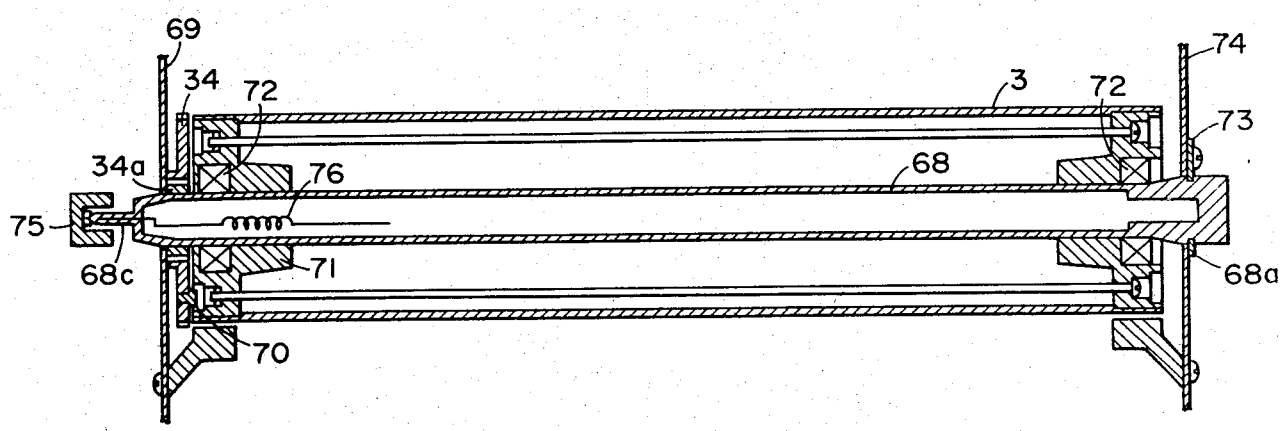
FIG. 6 is a longitudinal cross-section of a photosensitive drum shown in FIG. 1.

The photosensitive drum has a construction as shown in FIG. 6. The drum gear 34 is fitted on the outer periphery of a drum gear fixing screw **34*a* having a hole, into which a drum shaft 68 (to be mentioned hereinafter) securely fixed at the rear plate 69 is fitted. The drum gear 34 is freely rotatable in the drum gear fixing screw 34*a*, and is driven by the main motor through other gears, as already mentioned in the foregoing. A projection 70 provided on the side surface of the drum gear 34 enters into a groove of a drum flange 71, and, by rotation of this drum flange 71, the drum is rotated. Since the drum flange 71 is fitted on the drum shaft 68 through a bearing 72, the photosensitive drum 3 is freely rotatable with respect to the drum shaft 68. The front and rear position of the drum shaft 68 is determined by the drum shaft fixing plate 73 entering the groove 68*a* in front of the drum shaft. The upper and lower as well as the left and right positions of the drum shaft are determined by fitting it into a hole of the front plate 74 of the main body and the abovementioned drum gear fixing screw 34*a*. When the drum shaft 68 arrives at a predetermined position, the tip end 68*c* of the drum shaft 68 enters into a socket 75 which has been provided beforehand. By constructing the drum shaft with a hollow tube, a heat generating member 76 can be installed within the hollow shaft, and a power source therefor is taken from the abovementioned socket. The heating generating member 76** maintains the photosensitive member at a constant temperature to thereby make it possible to prevent the surface of the photosensitive drum from moisturizing at the time of high humidity, and to obtain image reproduction of satisfactory quality at a low temperature circumstance.

Figure 7:
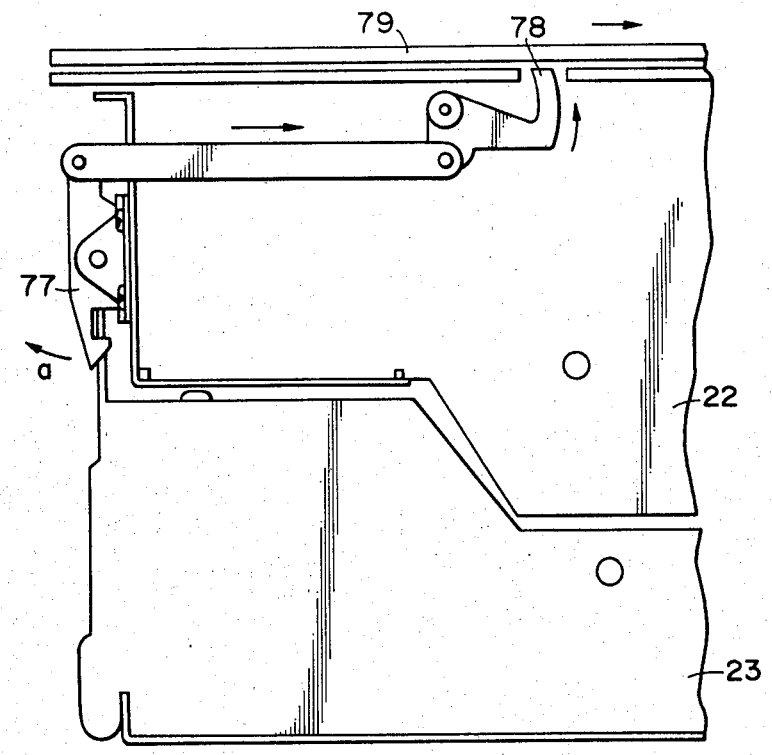
FIG. 7 is a partial front view showing a safety mechanism for an upper and lower main body opening mechanism in the apparatus shown in FIG. 1.
Figure 8:
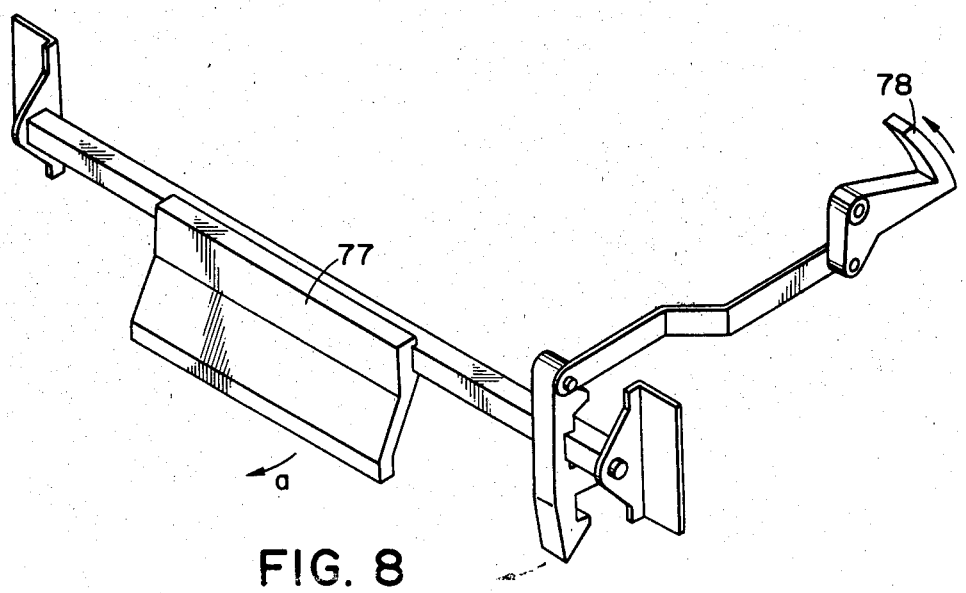
FIG. 8 is a perspective view of the safety mechanism shown in FIG. 7.

When the drum is removed from the main body, a blade of the cleaner (to be described later) is completely taken away from the drum surface, the component members of the cleaner are brought to such a position that the cleaner members may not touch the photosensitive drum, when the upper and lower main bodies 22, 23 are opened, and the image original mounting table is brought to a predetermined position, after which the threaded screw of the drum shaft fixing plate 73 is loosened to remove it from the groove 68*a* of the drum shaft, and the drum shaft 68 is moved to the front side (the right direction in FIG. 6). In this way, the photosensitive drum 3 is held on a drum holder provided on the lower main body 23. The position of the photosensitive drum on the drum holder is somewhat lower than the position where it is held by the drum shaft, as a result of which the photosensitive drum and the drum holder do not usually interfere each other. Further, the tip and 68*c* of the drum shaft 68 is in a tapered shape, so that insertion and withdrawal of the drum shaft in and out of the photosensitive drum is easy. Thereafter, the lock is released by the upper and lower main body release lever to split open the upper main body and the lower main body, whereupon the drum shaft remains on the drum holder to be readily removed out. Here, if the drum shaft 68 is pulled out without releasing the cleaner as will be mentioned hereinafter, the photosensitive drum 3 is impaired by its interference with the cleaner. In order to prevent such problem, the tip end of the cleaner lever is caused to be engaged with the groove 68*a* where the drum shaft fixing plate 73 enters. Because of this, the construction in this section is such that, when the cleaner is not released, the drum shaft cannot be pulled out. Further, the position of the image original mounting table, i.e., a distance from the pivot for opening the upper and lower main bodies, cooperates with the weight of the image original mounting table to act on the force required for opening the upper and lower main bodies. Because of this, the image original mounting table should desirably be at a fixed position at the time of opening the upper and lower main bodies. Furthermore, when the upper and lower main bodies are released, the main original mounting table slides downward to collide with a stopper, and stops. This, however, invites breakage of a glass plate, on which the image original is placed, and so on. In order to prevent such dangers from occurring, it may be sufficient to employ such a construction that the upper and lower main bodies cannot be released until the image original mounting table is moved in the vicinity of the stopper. Therefore, as shown in FIGS. 7 and 8, the device is constructed in such a manner that a pawl 78 may be projected through connection of an intermediate lever by pulling a release lever 77 in an arrow direction a. If and when the image original mounting table 79 is at the position where the pawl projects out, the release lever 77 cannot be pulled due to the pawl 78 interfering with the image original mounting table, whereby the operator realizes that the image original 79 should be moved up to a position in the vicinity of the stopper. Incidentally, the pawl in its ordinary state is retracted to a position where it does not interfere with movement of the image original mounting table. (see FIG. 7)

Image Original Mounting Table

Figure 9:
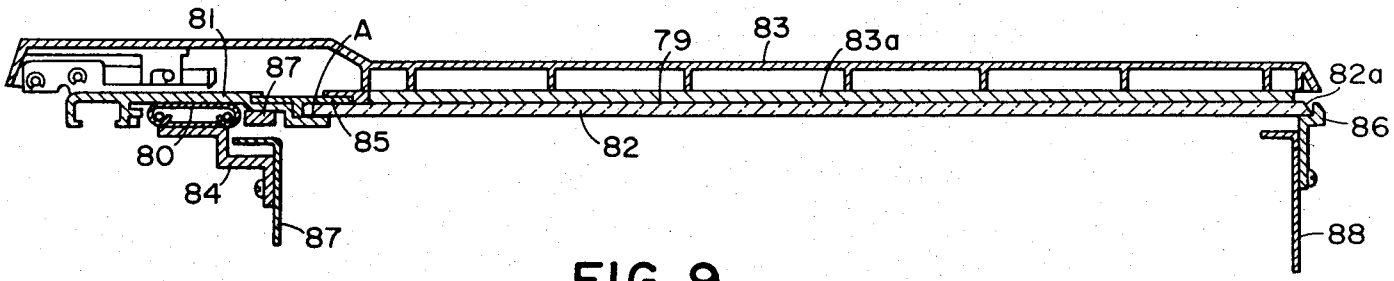
FIG. 9 is a cross-sectional view showing a construction of an image original mounting table shown in FIG. 1.

Referring to FIG. 9, the image original mounting table 79 comprises a guide rail 80 to effect the linear reciprocating motion of the table, an image original stay 81, a glass plate 82, on which an image original to be reproduced is placed, and a glass plate stopper 83 to hold the image original placing glass plate 82 together with the image original stay 81.

The guide rail 80 is fixed on a rail fixing bracket 84 fitted to the apparatus main body to effect smooth and linear movement of the image original table. The image original placing glass plate 82 is mounted on an elastic member 85 attached onto a section A of the image original stay 81, and is held by compressing the resilient member by the glass plate stopper. Because of this, the position of the image original glass is determined at the lower surface of the glass plate stopper, hence its holding power is sufficiently strong, and minimal force is applied to the image original placing glass plate. The upper and lower as front and rear positions of image original mounting table is regulated by fitting the image original stay 81 on the guide rail 80. The front side of the image original placing glass table is chambered as shown by a reference numeral 82*a* in the drawing. This portion is fitted with the groove of the front rail 68 fixed on the front plate of the main body to regulate its position in the up and down direction. A low frictional material is coated on the sliding surfaces between the front rail 86 and the image original placing glass plate to assist smooth sliding motion of the image original mounting table.

A magnet is fixed on the image original stay 81 so as to detect a position of the image original mounting table by a magnetic detection center 87 attached to the rear rail, thereby sequentially giving control signals.

The slide-motion of the image original placing table is effected by a driving wire connected to both ends of the image original mounting table. The driving wire is wound on a wire pulley which receives the driving force from the motor through the reciprocating clutch, as already mentioned in the foregoing. By controlling the reciprocating clutch, the image original mounting table is moved back and forth.

Further, since the stoppers 87, 88 provided at both ends of the image original stay 81 interfere with the stopper provided on the main body, the image original mounting table does not move more than necessary. However, by releasing the stoppers, the image original mounting table is able to perfectly pass by the position above the short focus lens array, hence cleaning of the short focus lens array also becomes easy.

Incidentally, the image original to be reproduced is sufficiently press-contacted onto the image original placing glass plate 82 by means of the image original pressing plate 83*a*.

Optical System

Figure 10:
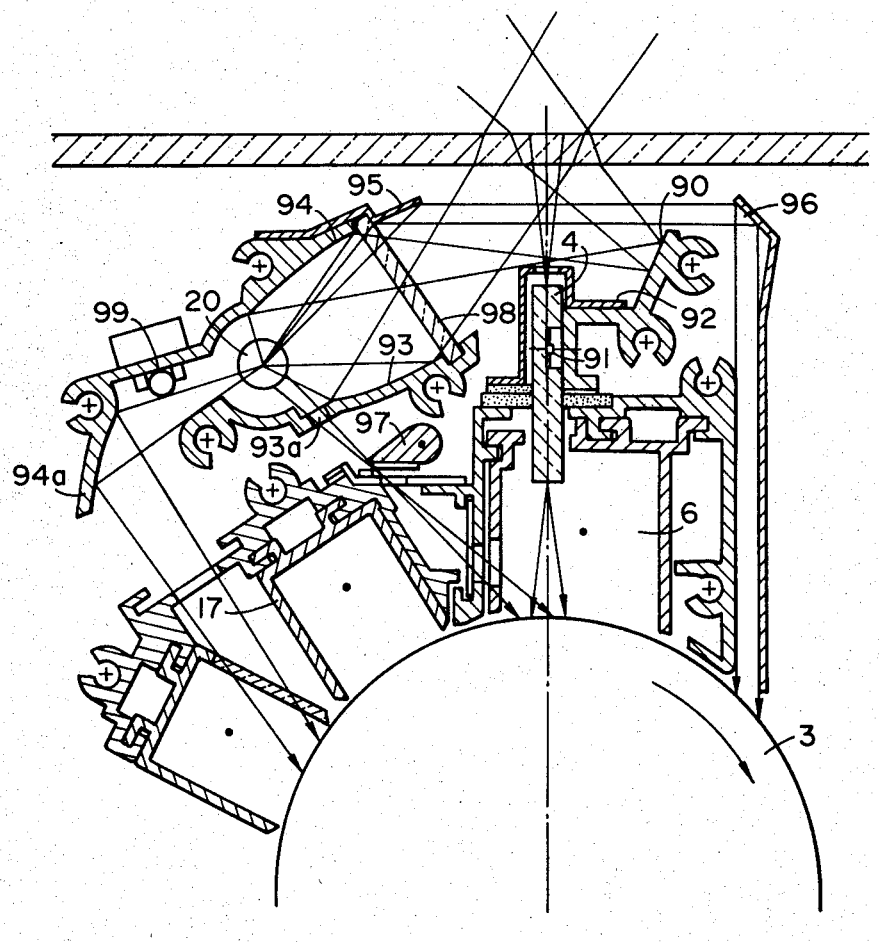
FIG. 10 is a cross-sectional view of an optical system in the apparatus shown in FIG. 1.

Referring now to FIG. 10, the optical system will now be explained.

The characteristic point of the optical system according to the present invention resides first in the use of the short focus image forming element array as the image forming element. Heretofore, there has been used a through-lens or an in-mirror-lens as the image forming element of the reproduction apparatus. Owing to this, the space occupied by the optical system in the reproduction apparatus has been considerably large, which inevitably causes the apparatus main body to be correspondingly large. In contrast to this, the apparatus according to the present invention constructs the optical system in a very compact size by adopting the above-mentioned short focus small image forming element array, which succeeds in reducing the size of the apparatus main body.

The second characteristic point of the optical system according to the present invention resides in that the entire exposure necessary for the image forming steps is done by a single illuminating light source, whereby energy saving in the present apparatus becomes possible.

In the following, detailed construction of the abovementioned optical system will be explained, in reference to FIG. 10 which shows a cross-section of the optical system and related members therearound. The short focus small image forming element array 4 is positioned just above the photosensitive drum 3. A pin 91 fixedly provided on the first auxiliary reflecting mirror 90 is fitted in a hole formed in the vicinity of both ends in the longitudinal direction of the photosensitive drum (a portion not participating in the image formation), thereby fixing its position. Also, a light intercepting plate 92 fixed on the first auxiliary reflecting mirror 90 surrounds the short focus small image forming element array 4 to cover it except for the image light passing region, thereby effecting prevention of light leakage to the electrostatic latent image forming area and providing a heat-shield to the image forming elements. A reference numeral 20 designates a halogen lamp as the light source. A part of the illuminating light is fed to the image original surface through a stepped oval reflecting mirror 93 with the center of the lamp at the focal point. Another part is converged on the second focal point through an oval reflecting mirror 94 with the center of the lamp as its focal point, after which it is led to the image original surface through the first auxiliary reflecting mirror 90. The image original is illuminated by these two illuminating lights and direct illuminating light from the halogen lamp 20, whereby the original image is formed on the photosensitive drum 3 through the short focus small image forming element array 4. Still another part of the illuminating light is led to the photosensitive drum 3 as a post-exposure light through the second auxiliary reflecting mirror 95 having a reflecting surface, with the center of the lamp as its focal point and in which a parabolic line has been approximated by a rectilinear line, and the third auxiliary reflecting mirror 96, whereby an electrostatic latent image is formed on the surface of the photosensitive drum 3. Yet another part of the illuminating light is led to the photosensitive drum 3 as a pre-exposure light through an arcuate reflecting section **94*a* forming a part of the oval reflecting mirror 94 to render uniform the potential on the surface of the photosensitive drum together with the corona current by the pre-charge remover 17**.

Besides the abovementioned illuminating light, at the return motion of the image original mounting table, a shutter 97 is opened by a solenoid (not shown) which operates in synchronism with the return motion of the image original mounting table to lead a part of the illuminating light to the photosensitive drum 3 through a hole **93*a* formed in the stepped oval reflecting mirror 93 so that the charge on the surface of the photosensitive drum 3** may be eliminated and the load to the cleaning section may be lessened.

A reference numeral 98 designates a near infrared cut filter, on the glass surface of which an interference thin film is evaporatively deposited. This filter compensates color sensitivity of the photosensitive drum, and also intercepts the infrared ray to prevent the image original placing glass plate from increasing its temperature.

A reference numeral 99 designates a temperature fuse which prevents the optical system and the surrounding units from being thermally destructed due to abnormal lighting of the halogen lamp 20.

Developing Device

Figure 12:
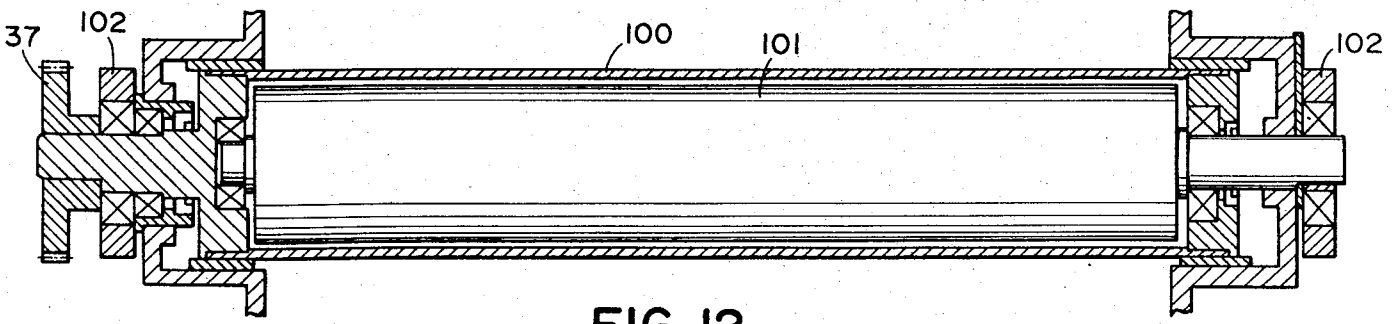
FIG. 12 is a longitudinal cross-sectional view showing a construction of a developing sleeve in the apparatus shown in FIG. 1.
Figure 11:
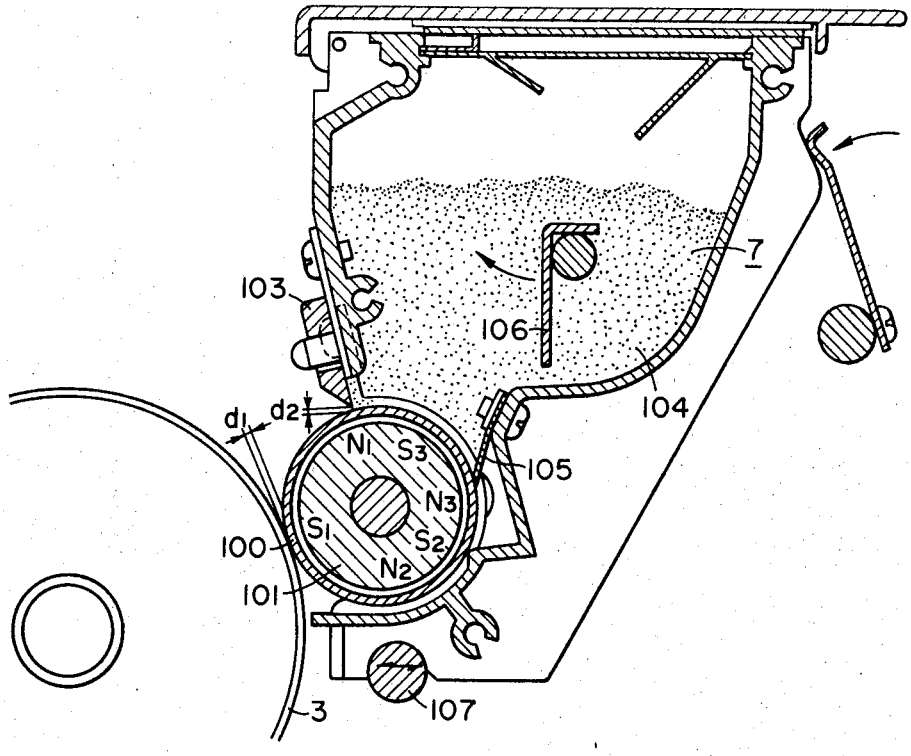
FIG. 11 is a cross-sectional view showing a developing device in the apparatus shown in FIG. 1.

Referring now to FIGS. 11 and 12, explanations will be given as to the developing device. This developing device is to effect the image development by use of a one-component magnetic developing agent as described in the U.S. patent application Ser. No. 58,434 and Ser. No. 58,435 referred to in the foregoing. A developing sleeve 100 in this developing device is rotatably held around a fixed internal magnet 101, the outer periphery of which rotates in such a manner that its relative speed with the photosensitive drum 3 becomes substantially zero. The developing sleeve 100 is rotated by the gear 36 fixed on one and the same shaft of the sleeve and the drum gear 34. A space gap $d_1$ between the developing sleeve 100 and the photosensitive drum surface is maintained by a spacer roller 102 coaxially provided on the same sleeve at 300 microns.

By rotation of the sleeve 100, a very thin layer of the toner (100 microns or so) is formed on the surface of the developing sleeve. Thickness of the toner layer is determined by a blade 103 made of a magnetic material and provided in contiguity (a distance of $d_2=250$ microns) to the sleeve surface, and intensity of the magnetic pole ($N_1$ in the illustration) of the magnet 101 within the sleeve. The toner 104 coated on the sleeve surface adheres to the latent image formed on the photosensitive member by an electrostatic force and an a.c. bias as well as at a position opposite to the photosensitive drum 3, thereby performing the image development. The toner remaining on the surface of the developing sleeve 100 is scraped off its surface by a scraper 105 with a multitude of square holes being arranged in the axial direction of the sleeve. The scraped toner passes through the square holes in the scraper and adheres to the sleeve surface again.

An agitating rod 106 for preventing the toner particles from cross-linking is provided in the developer container. The rod 106 performs an intermittent rotation by cooperation of an eccentric cam and pawl integrally formed with the gear provided on one and the same shaft of the sleeve 100, and a ratchet wheel.

The developer container is mounted on a shaft 107 fixed on the upper main body, and the contact roller 102 is fixed so that it may press-contact the drum surface.

In the developer container, there is provided a well known toner quantity detector constructed with a CdS element, a light guide, and a lamp. This detector generates a display signal when the toner becomes lower than a certain definite quantity level. The abovementioned CdS element and the light guide surface are cleaned by a cleaning member so as to prevent adhesion of the toner particles. The cleaning member is fitted on the agitating rod and rotated intermittently.

For further details of the developing device, reference will be had to Japanese Patent Application No. 54-60783.

Cleaner

Figure 13:
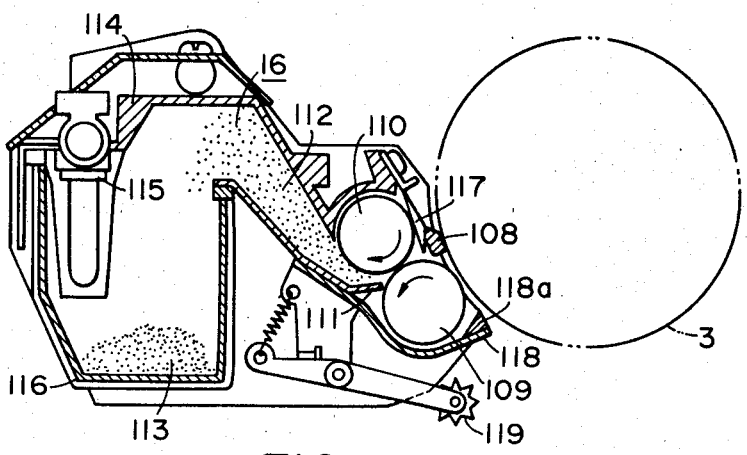
FIG. 13 is a cross-sectional view of a cleaning section in the apparatus shown in FIG. 1.
Figure 14:
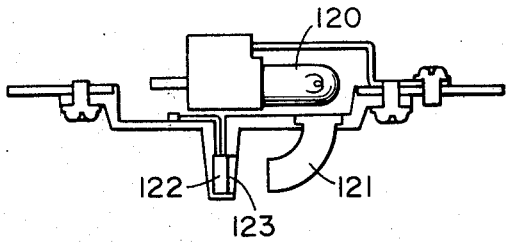
FIG. 14 is a side elevational view of a toner charging detector in the cleaning section shown in FIG. 13.
Figure 15:
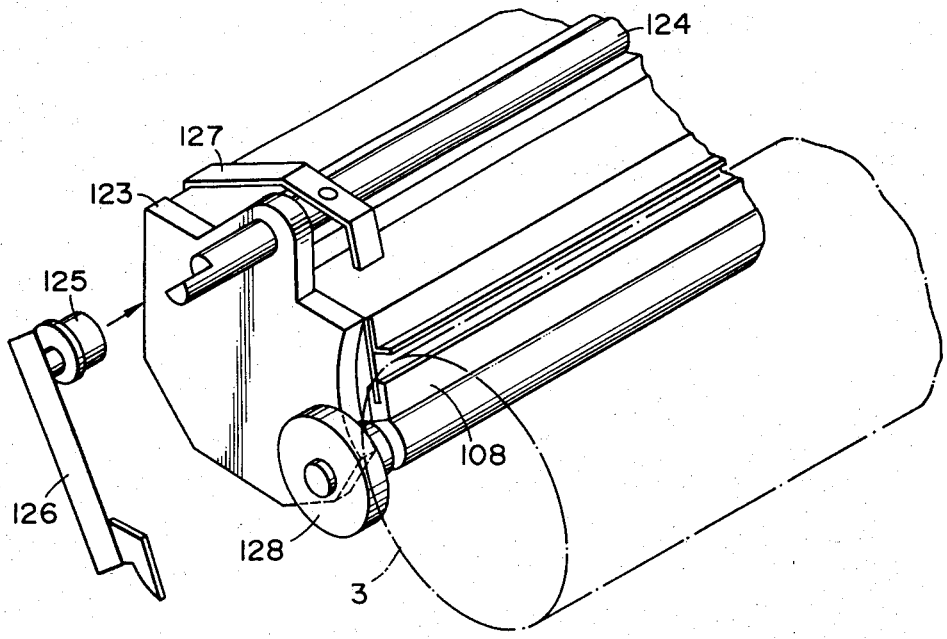
FIG. 15 is a perspective view showing a fitting part of the cleaning section shown in FIG. 13.

Referring to FIGS. 13 to 15, explanations will be made as to the cleaning device. The cleaning section 16 is of a blade cleaning system using a tip blade 108 made of urethane rubber provided at the tip end of a resilient member.

As shown in FIG. 13, the residual toner on the photosensitive drum 3 is scraped off by the tip blade 108 and attracted to a magnet roller 109 positioned therebeneath. At the end part of the magnet roller 109, there is provided a gear 37 for driving the magnet roller, which is meshed with the drum gear 34. The magnet roller driving gear 37 receives the driving force from the drum side, whereby the magnet roller 109 rotates in an arrow direction. The gear 37 also rotates an iron roller 110.

By the rotation of the magnet roller 109, the toner on the magnet roller is sent into a toner conveying path 112 by a scraper 111. The toner is then raised upward in the toner conveying path 112 by the pumping action of the magnet roller 109 and the iron roller 110, and recovered in a toner cassette 113.

As soon as the toner in the toner cassette 113 reaches a certain determined quantity, a control signal is emitted from an upper stay 114 by a fill-up detector 115 installed in the toner cassette, whereby a toner recovery display in the display section turns on and off, and the copying operation is disabled. At this instant, hooks on both ends of the toner cassette are released, and the cassette is thereby removed from the cleaner unit. Inside the toner cassette 113, there is placed a discharged toner case 116 made of polyethylene and having a thickness of 0.3 mm. After this toner case filled with the recovered toner is discharged, the toner cassette with a fresh discharged toner case placed therein is loaded in the cleaner unit, and the copying operation is resumed.

A numeral 117 refers to a paper diverting plate which prevents reproduction paper, which has reached the cleaning section for one reason or another, from being wound in between the magnet roller 109 and the iron roller 110.

The tip end of a lower stay 118 prevents the toner from scattering to the lower part of the device i.e., the toner conveying section. It has several numbers of ribs 118*a* arranged at a certain definite space interval among them so as to provide a space to hold the dropping toner which occurs at the time of removing the reproduction paper when it has arrived at the abovementioned cleaning section.

The paper diverting roller 119 regulates flotation of the reproduction paper from the conveying section, hinders the reproduction paper from being attracted to the cleaning section, and securely performs the image transfer, separation, and conveyance.

The toner fill-up detector has the construction as shown in FIGS. 13 and 14. Light emitted from a small bulb 120 is guided by a light guide 121 made of acryl resin, and is projected onto the surface of a light receiving element (CdS) 123 positioned at a certain distance. When the quantity of the toner within the toner cassette increases and the toner accumulates between the abovementioned light guide 121 and the light receiving element 123, the light travelling toward the light receiving element is intercepted, and its resistance increases. This increase in resistance is detected to generate a control signal. Any well known control circuit can be used for this toner fill-up detector.

The cleaner unit is loaded onto the main body by means of a cleaner supporting shaft 124 fitting into a hole perforated in the rear plate of the main body and a flange 123 passing into the front plate of the main body from outside. The cleaner supporting shaft 124 and the rotational shaft 125 are fitted in the cross-sectional shape of a letter "D" within the flange 123.

A cleaner lever 126 is fitted on the rotational shaft 125 outside the front plate of the main body. By rotating this cleaner lever 126, the cleaner supporting shaft 124 is rotated, and a pressure spring 127 fitted on the cleaner supporting shaft 124 urges the cleaner unit, and contact rollers 128 provided on both ends of the magnet roller contact the photosensitive drum 3, thereby determining the blade position. In this way, a space interval between the magnet roller 109 and the drum as well as the position of the blade are secured.

When mounting or removing the photosensitive drum, the cleaner lever 126 is manipulated so as to move the cleaner unit away from the surface of the drum.

Image Fixing Device

Figure 16:
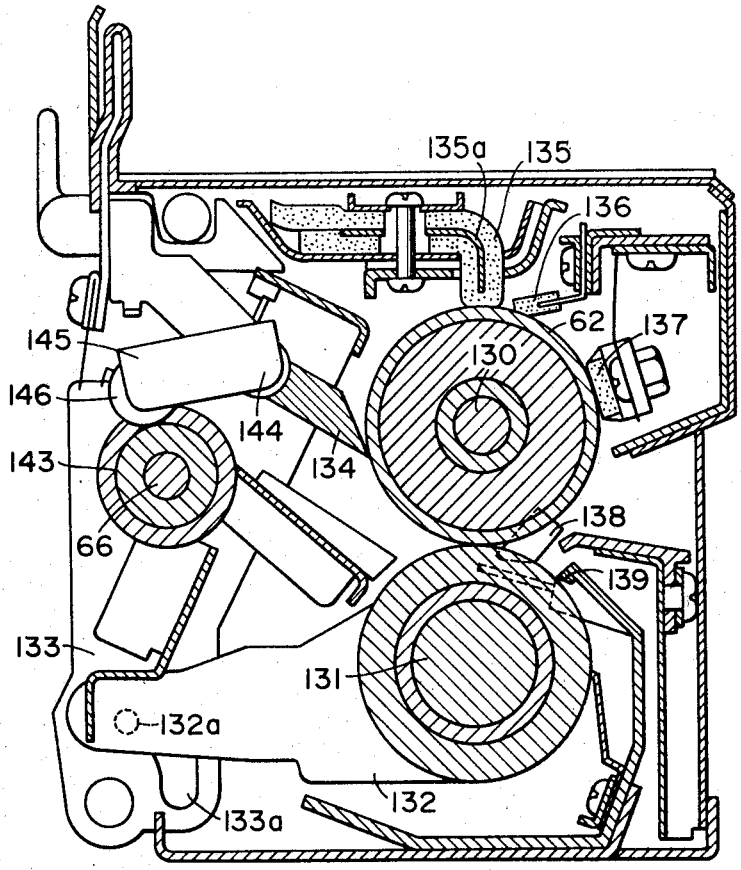
FIG. 16 is a cross-sectional view of an image fixing device in the apparatus shown in FIG. 1.
Figure 17:
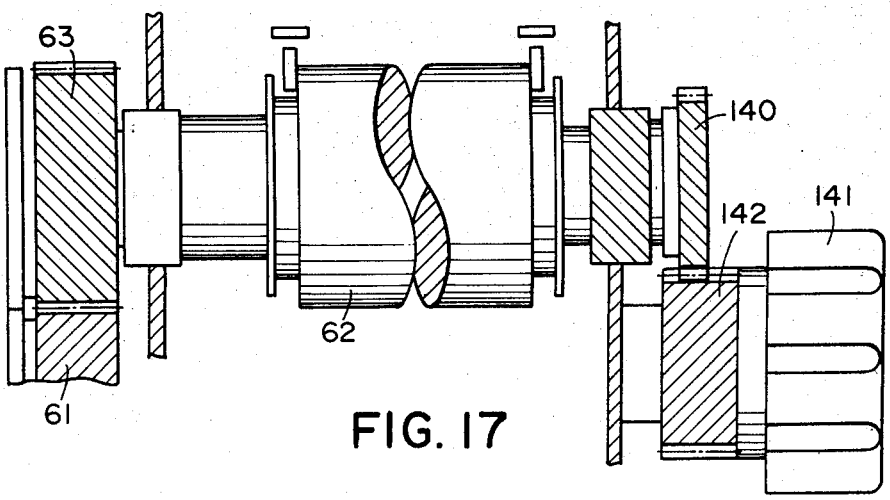
FIG. 17 is a front view of a fitting part of an upper fixing roller in the image fixing and discharging device shown in FIG. 16.

Referring to FIGS. 16 and 17, explanations will be given as to the image fixing device.

The image fixing device 14 is to fix a toner image by causing a toner image bearing member to pass between a pair of heated rollers under pressure. An image fixing upper roller 62 is rotatably supported on a shaft at its definite position on both front and rear plates of the image fixing device so that the toner image on the surface of the toner image bearing member may be pressed. The image fixing upper roller 62 is a hollow cylindrical metal tube having tetrafluoroethylene resin coated on its outer peripheral surface and a heater 130 installed within the hollow cavity. An image fixing lower roller 131 is constructed with a core metal and silicone rubber wrapped therearound, and is rotatably supported at its both ends on pressure applying arms 132, 132. By a mechanism to be described hereinafter, the image fixing lower roller 131 becomes elastically deformed when it is urged by the image fixing upper roller 62, whereby a pressure required for the image fixing develops between the upper and lower rollers. One end of the pressure applying arm 132 is rotatably supported on the front and rear plates of the image fixing device, while the other end is engaged, by way of a shaft 132*a*, with a cam hole 133*a* formed in the oscillatable front and rear plates 133 of the paper discharging section which are pivotally supported on the front and rear side plates of the image fixing device. When the paper discharging section is closed (i.e. at the time of operation), the pressurize applying arm 132 upwardly rotates by the cam action, and the image fixing lower roller 131 is press-contacted to the image fixing upper roller 62. When the toner image bearing member is clogged within the image fixing device, the paper discharging section is opened to remove the image bearing member. At that time, the image fixing lower roller comes downward to release or reduce the pressure as applied thereto. Surrounding the image fixing upper roller 62, there are disposed separating pawl 134, a silicone oil applicator 135, a rubber blade 136, and a thermistor 137, all being in contact with the upper roller 62.

The separating pawl 134 is to exfoliate the toner image bearing member when it adheres onto the image fixing upper roller. For this purpose the surface of the pawl in contact with the surface of the upper roller is knife-edged and coated with tetrafluoroethylene resin. The applicator 135 is to apply silicone oil onto the surface of the upper roller to prevent offsetting of the toner thereonto. The applicator is of such a construction that a bag made of porous sheet of tetrafluoroethylene is disposed at the opening part of a container having an elongated hole at its bottom in the direction parallel to the shaft of the upper roller, and a felt 135*a* impregnated therein with silicone oil is placed in the bag so that the oil may exude through the porous tetrafluoroethylene bag. The tetrafluoroethylene bag contacts the surface of the upper roller to apply the oil on its surface. The rubber blade 136 is constructed by integrally shaping a heat resistant rubber on the edge of a resilient metal plate. The blade is to clean the upper roller surface and to evenly spread the silicone oil applied on it. The thermister 137 is of such a construction that a heat sensitive element placed on a heat resistant sponge is firmly fixed with a heat resistant tape. The surface side of the tape is constantly urged by a leaf spring onto the surface of the upper roller so as to maintain the surface of the roller at a temperature required for the image fixing. A groove is formed on both sides of the image fixing upper roller 62. The groove is to drop excessive amounts of silicone oil downward as regulated by the rubber blade.

A heat resistive member 138 is press-contacted to the side surface of the groove at the lower part of the upper roller 62. The oil dropped along the groove is guided to the heat resistive member 138 to drop onto a projection, provided at the lower position of the heat resistant member, in an oil tank disposed below the image fixing lower roller, and collected in the oil tank.

Figure 18:
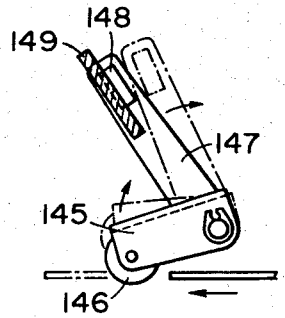
FIG. 18 is a side elevational view for explaining the action of a paper jam detection roller.

A metal blade 139 is press-contacted to the image fixing lower roller 131. This metal blade is to clean the lower roller surface as well as scrape off excessive silicon-oil adhered onto the roller surface. The image fixing upper roller 62 is rotated by the image fixing device driving gear 61 through the gear 63 provided at one end thereof (vide: FIG. 5). The image fixing lower roller 131 rotates in pursuance of the image fixing upper roller 62 due to the frictional force between them. Further, a gear 140 is fixed at the other end of the image fixing roller 62, as shown in FIG. 17, and meshed with a gear 142 integral with a knob 141. This is facilitate treatment of the paper jamming by manually rotating the roller when removing the toner image bearing member jammed within the image fixing device. A paper discharging roller 143 for discharging the toner image bearing member from the image fixing upper and lower rollers into a receiving tray is disposed in the paper discharging section. The paper discharging roller 143 is driven by the image fixing upper roller gear 63. The paper discharging section is also provided with detecting means for detecting the toner image bearing member. A detecting arm 145 is fixedly provided at one end of the rotational shaft 144 to the side where the image bearing member passes, and a rotatable roller 146 is provided at the tip end of the detecting arm 145. The roller 146 is imparted with a counterclockwise rotational behavior so that it may lightly contact a definite portion of the groove formed in one part of the paper discharging roller 143. On the other hand, a magnet arm 147 is fixedly provided at the other end of the arm 145, as shown in FIG. 18, and a magnet 148 is fixedly provided at its tip end. A reed switch 149 is provided at a position adjacent as well as opposite to the magnet 148. When the toner image bearing member enters the paper discharging roller 143, the roller 146 of the detecting arm moves up to the top surface of the groove, i.e., to the other peripheral surface of the paper discharging roller. This movement of the roller 146 is transmitted to the magnet arm 147 through the rotational shaft, and the magnet 148 moves from its position facing the read switch 149, and the switch is changed over from its "on" state to "off" state, thereby detecting delay in movement of the toner image bearing member and staying within the main body. On the other hand, the image fixing device not only has the image fixing function, but also serves as the structural members of the reproduction apparatus main body. That is to say, the reproduction apparatus according to the present invention is split into upper and lower main body portions as described in the foregoing so as to improve the paper jam treatment, maintenance and repair of the machine. These two split main body portions are constantly given the rotational behaviour in the clockwise direction (i.e., direction of release) by a spring. The image fixing device 14 is fixed to the bottom plate of the lower main body, and a rectangular hole to engage a hook 150 of the upper main body is formed at the top end part of the front and rear side plate of the paper discharging section (vide: FIG. 3).

Paper Feeding Mechanism

Figure 19:
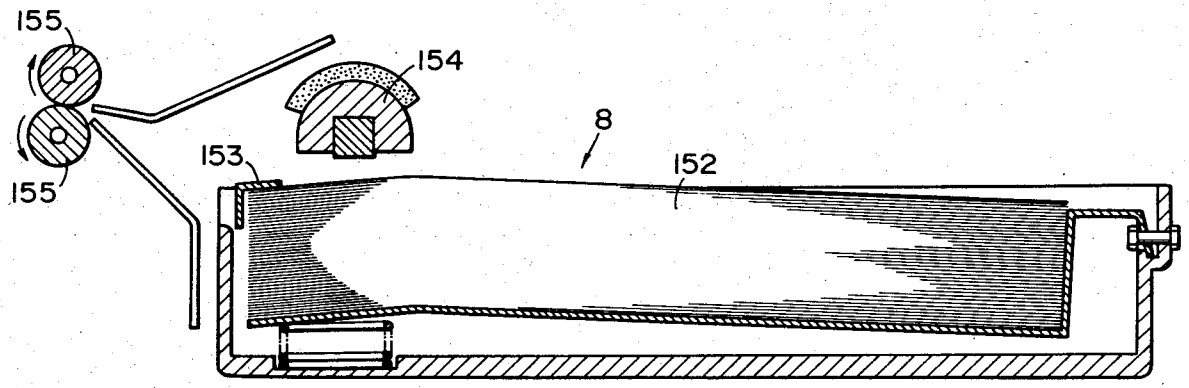
FIG. 19 is a cross-sectional view of a paper feeding cassette shown in FIG. 1.

In the following, the feeding mechanism for the image transfer paper will be explained in reference to FIGS. 19 and 20.

According to the present embodiment, the paper feeding mechanism has two paper feeding modes. The one is a cassette paper feeding mode, and the other is a manual paper feeding mode. In the ordinary copying operation, a paper cassette 8 stacked therein with image transfer paper in a desired size is loaded on a cassette loading table, and the image transfer paper 152 is separated sheet by sheet from the stack by a pawl provided within the cassette, and fed into the reproduction apparatus. On the other hand, the manual paper feeding mode is provided for the purpose of enabling a small quantity of reproduction copy to be obtained, which differs in size from the cassette size loaded in the apparatus, or of performing an intervening copying of a different size (vide: FIG. 1).

First of all, the cassette paper feeding mode will be explained. A positioning projection (not shown) is provided in the cassette 8. This position projection is engaged with a groove in the cassette table, and the cassette is fixed at its position, whereby the image transfer paper 152 within the cassette is placed in its standby state for the paper feeding. When a copy start button is depressed, the paper feeding roller 154 performs its half rotation from the illustrated position. After a certain amount of the image transfer paper 152 has been fed into the reproduction apparatus from the cassette, the paper feeding stops once by stoppage of the paper feeding roller. A clutch (not shown) is connected to the paper feeding roller 154, and rotation of the paper feeding roller is restricted by this clutch. Next, the image original mounting table 18 (in FIG. 1), after it has moved once in the rightward direction in the drawing, begins to move reversely leftward; whereupon the image original exposure is started. During movement of the image original mounting table, a signal enters into the clutch at its predetermined position, whereby the paper feeding roller 154 again rotates half way to further feed the image transfer paper. At this time, the image transfer paper 154 reaches a pair of timing rollers 155, 155 to form a loop by its own tenacity, and stops where its front edge is held between the pair of the timing rollers 155, 155. At this instant, the pair of the timing rollers are in stoppage (vide: U.S. patent application Ser. No. 64,896).

In the manual paper feeding mode, when the image transfer paper is inserted into a pair of manual paper feeding rollers 156, 156 (FIG. 1) through the manual paper insertion guide 9*a*, the first detecting plate 157 provided in its travelling path oscillates in the clockwise direction to intercept light from a photo-interruptor (not shown) provided in the neighborhood of the first detecting plate, whereby the paper detection is actuated. This detection signal is introduced as an input into a clutch (not shown) connected to the lower manual paper feeding roller 156. After the pair of manual paper feeding rollers start rotation upon introduction of the detection signal and a certain definite quantity of the image transfer paper has been fed into the reproduction apparatus, the paper feeding is stopped once due to stoppage of the manual paper feeding rollers. Rotation of the manual paper feeding rollers is controlled in the same manner as in the abovementioned paper feeding rollers 156,156, and the mode of travelling of the image transfer paper after its introduction into the apparatus is exactly same as in the case of the abovementioned cassette paper feeding mode, hence detailed explanations thereof will be dispensed with.

The timing rollers 155, 155 are so constructed that the lower timing roller constitutes a driving side, to which a clutch (not shown) is connected so as to control the roller drive. On the other hand, the upper timing roller is urged to the lower timing roller by means of a spring (not shown) provided at both ends of the shaft, and rotates in pursuance of the lower timing roller.

An electrostatic latent image in accordance with the original image is formed on the photosensitive drum 3 by exposure of the image original. This latent image is developed by the developer 7. Upon the latent image development, the clutch connected to the lower timing roller is actuated with a view to accurately register the developed image corresponding to the original image and the image transfer paper in the image transfer step, whereby the pair of the timing rollers start rotation, and the image transfer paper held between these timing rollers, i.e., the image transfer paper which has been waiting for its feeding between the first paper feeding guide 158 and the second paper feeding guide 159, or between the second paper feeding guide 159 and the third paper feeding guide 160 (FIG. 1) is sent into the image transfer region, the upper image transfer guide 161 and the lower image transfer guide 162 as shown in FIG. 20.

Since the upper image transfer guide 161 is contiguous to the photosensitive drum 3 at its front edge, an electric field tends to gather at this edge portion and the developer is prone to be adhered thereon. In order therefore to avoid this, the upper image transfer guide is made of an insulative material. On the other hand, the image transfer paper 152 is sent into the image transfer region along the upper image transfer guide 161, so that both are charged by the friction therebetween which is apt to cause insufficient synchronism of the image transfer paper 152 with the image on the surface of the photosensitive drum, and further paper jamming between the upper and lower image transfer guide. In order to avoid such troubles, the upper image transfer guide 161 is provided at its surface side facing the image transfer paper with ribs **161*a* to reduce the contact area with the image transfer paper (FIG. 20**).

Figure 20:
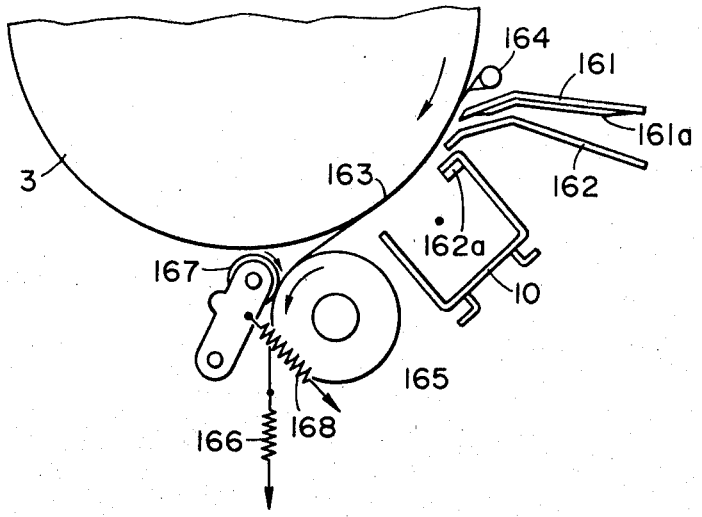
FIG. 20 is a partial side elevational view for explaining an image transfer and separation section shown in FIG. 1.

Also, the front edge of the lower image transfer guide 162 to the side of the photosensitive drum is provided with tongue-shaped cut-outs directed to the image transfer region at several locations therein along the direction of the drum shaft so as to prevent the rear edge of the paper from fluttering due to its tenacity, disturbing the image on the photosensitive drum surface, or causing insufficient image transfer when the image transfer paper 152 leaves the front edge of the image transfer guide and enters into the image transfer region (FIG. 20).

Now, in the image transfer region, the image transfer paper 152 receives corona discharge from the image transfer charger 10 from its back surface to cause the image on the photosensitive drum surface to be transferred thereto, after which it is separated from the drum and forwarded to the paper conveying section. Here, as shown in FIG. 20, the shield plate of the image transfer charger 10 is inwardly bent at one of its edge portions confronting the photosensitive drum so as to deflect the corona current to increase its image transfer efficiency. Inside this inwardly bent edge, an insulative member **162*a*** is provided.

Separation Mechanism

Figure 21:
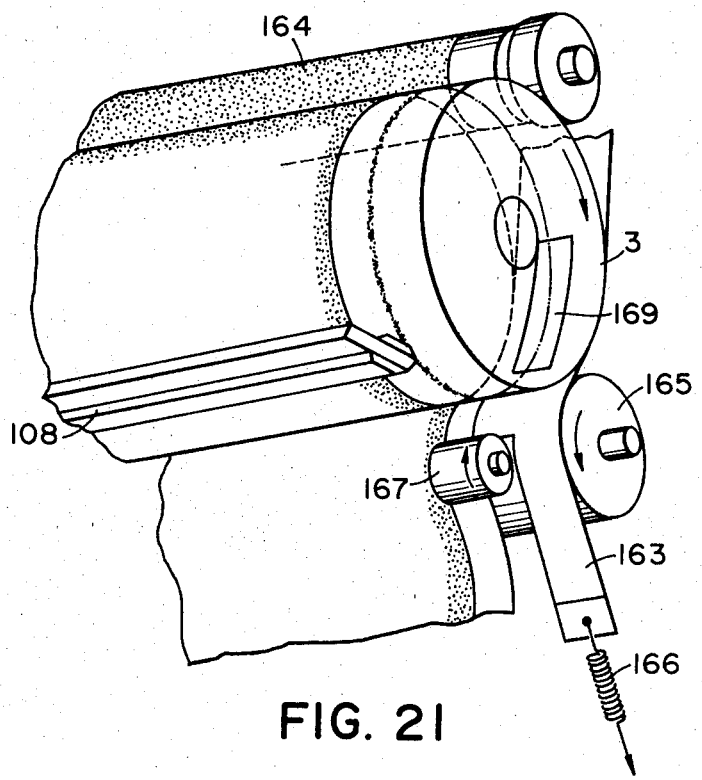
FIG. 21 and FIG. 22 are respectively perspective views showing the image transfer and separation section in FIG. 20.
Figure 22:
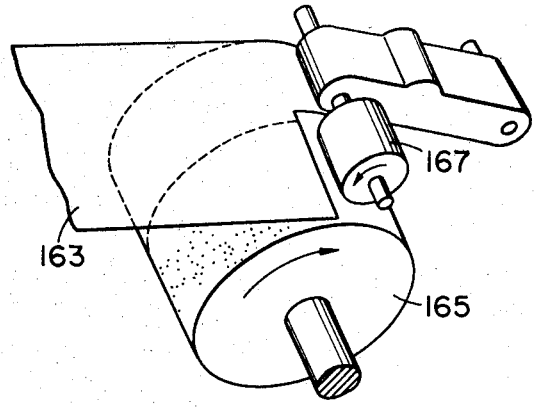

In the following, explanations will be given as to the paper separation mechanism in reference to FIGS. 20 to 22.

A separation belt 163 is provided in contact with one side portion of the outer peripheral surface of the photosensitive drum along the direction of the drum shaft, with one end fixed on a shaft 164, and the other end connected to a spring 166 by way of a separation roller 165 so as to be subjected to tension. A separating roller 167 is also press-contacted to the separating roller 165 (the driving side) by means of a spring 168. The positional relationship among the separating belt 163, the separating roller 165, and the separating roller 167 is as shown in FIGS. 20 to 22.

After its passage through the image transfer step, the image transfer paper 152 is peeled off the surface of the photosensitive drum by the separating belt 163, reaches the separating roller 165, is then held between the separating roller 165 and 167, and conveyed to the conveying section. The separating belt 163 has an escape hole **16*a* at a position corresponding to the edge portion of the cleaner blade in the direction of the drum shaft so as to prevent contamination due to scattering of the toner to its end portion from the cleaner blade 108, as shown in FIG. 21**.

As explained in the foregoing, the image transfer paper 152 is separated from the photosensitive drum 3 and reaches the conveying section, during which the image transfer paper is subjected to the charge removal from its back surface by means of a charge removing stylus (not shown) at the time of commencement and completion of the separation, thereby preventing disturbance of the transferred image due to abrupt discharge of the electric charge which the image transfer paper possesses.

In the conveying section, the image transfer paper moves on the conveyor belt 170 (FIG. 11) and sent to the image fixing device 14. In this instance, the conveyor belt is stretched between the first conveyor roller 171 (driving side) and the second conveyor roller 172, and is subjected to tension by a tension roller 173, thereby performing conveyance of the image transfer paper. Also, in the neighborhood of the center of the conveying belt in the conveying section, there is provided an auxiliary conveying roller 179 which receives the driving force from the first conveying roller 171, and a pinch roller **179*b* urged to the auxiliary conveying roller 179 by a spring 179*a* (FIG. 1). The pinch roller 179*b* is substantially at the same position as the abovementioned separating roller 167 in the direction of the drum shaft. The image transfer paper is held between this pinch roller 179*b* and the auxiliary conveying roller 179 to thereby improve the conveying capability. In the absence of this separating roller 165 and the auxiliary conveying roller 179, conveyance of paper of a size smaller than the conveying path between the separating roller 167 and the image fixing roller 14 is effected by the conveying belt 170** alone, hence the conveyance is unstable. Therefore, this pair of rollers is very effective for conveyance of a image transfer paper of a smaller size.

Lastly, the image transfer paper 152 passes through the image fixing device 14 where the image on its surface is fixed, after which it passes through the paper discharging roller 143 and is discharged into the paper receiving tray 15.

Heat Discharging and Ozone Removing Mechanism

Figure 24:
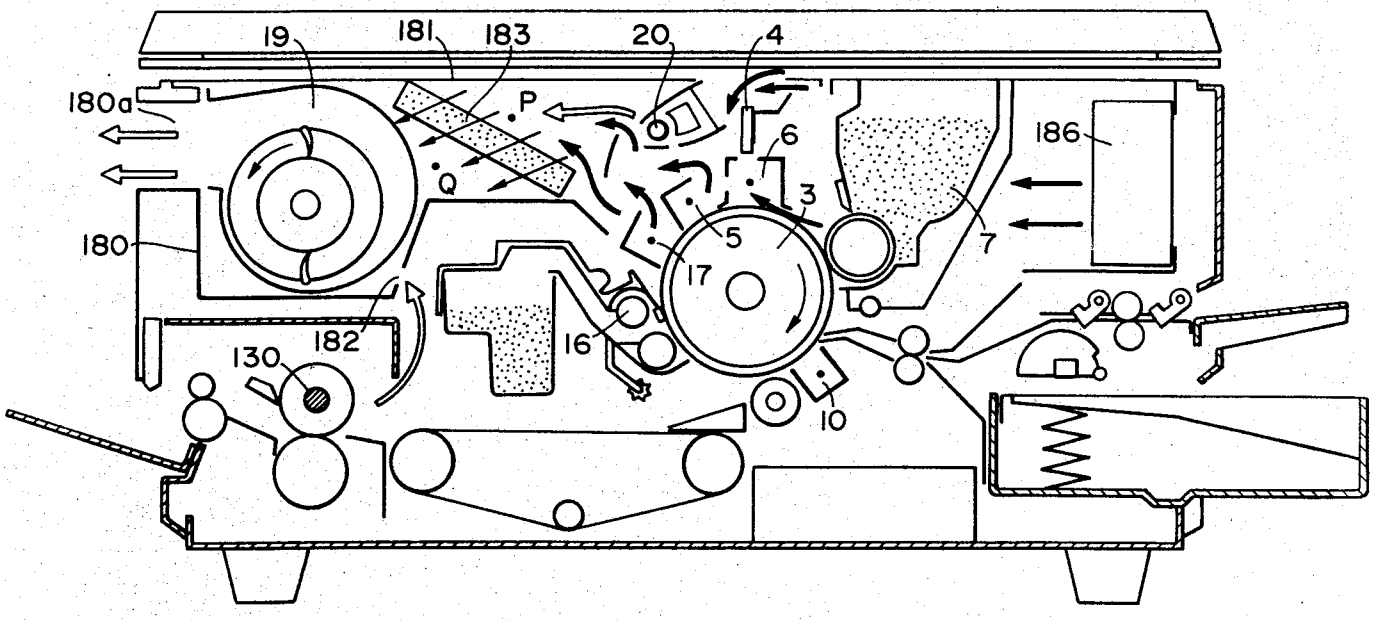
FIG. 24 is an explanatory diagram showing the flow of the ozone ion and the flow path of air current in the apparatus.

A preferred embodiment of the heat discharging and ozone removing mechanism according to the present invention will be described in reference to FIG. 1 showing the cross-sectional side view of the reproduction apparatus and FIG. 24 showing the direction of air current flow controlled within the reproduction apparatus and the direction of controlled flow of ozone generated with corona discharging.

First of all, the phenomenon of the ozone generation in such electrophotographic apparatus will be explained. In the electrophotographic apparatus, use of the corona discharger is indispensable for uniform application (charging) of electrostatic charge to the photosensitive member. Further, depending on the process for forming the electrostatic latent image, use of the corona dischargers is particularly effective, as is the use of secondary corona discharger, for transfer of image to the image transfer material after its development, charging and charge-removing before the image transfer, separation of the image transfer paper from the surface of the photosensitive member after the image transfer, and removal of residual charge from, and uniform application of the charge to, the photosensitive member. Typical corona generating devices employed heretofore are those as described in U.S. Pat. No. 2,777,957 (Walkup) and No. 2,836,725 (Vyverberg).

When such corona discharge is effected, air surrounding the corona discharge wire brings about the insulative destruction, and the air in this portion is ionized. Ion produced by this ionization migrates toward the opposite electrode (back surface electrode of the photosensitive member) in accordance with its polarity to thereby charge the surface of the photosensitive member. At this time, gas molecules move in the migrating direction of the ion by collision of the ion drifted by the electric field to the gas molecules with the consequence that there takes place a kind of wind (which is called "ion wind"). While the wind itself does not contain therein any ion, it contains a considerably large amount of ozone and nascent oxygen.

Of these, since ozone ($O_3$) has a weight approximately 1.7 times as heavy as air, even if it is discharged outside the reproduction apparatus by a gas exhausting mechanism, it tends to remain around the reproduction apparatus. This ozone gas emits a disagreeable odor which, when inhaled in the human body at a quantity higher than permitted, produces an undesirable effect on the respiratory organ, which is not favorable from the standpoint of hygiene. Therefore, the substance might cause great hazard in this type of office machine.

In addition, if a large amount of ozone remains around the reproduction machine, those surrounding units are easily oxidized. In particular, the corona discharge wire and the shielding material surrounding the wire are remarkably affected by the ozone, whereby floating substances in the air are oxidized and adhere to the wire and the shielding material, deteriorating the corona discharging efficiency.

Accordingly, it has so far been a practice to provide an ozone filter in the reproduction apparatus to lower concentration of ozone in the air to be discharged outside the apparatus, thereby eliminating the odor of ozone, and, at the same time, a particular cleaning device is provided on the corona discharge wire, etc. to prevent deterioration of the same due to ozone.

However, as the reproduction apparatus for office use tends to be miniaturized permitting installation at any location in the office in much same way as typewriters, this increases the necessity for performing much stronger deodorizing and filtering functions of the ozone. Furthermore, heat current (amounting to 80° C. or so) from the exposure light source, the heat fixing device, and so on should be sufficiently cooled for discharging outside. It has therefore become very important to take such safety measures in such small-sized office varying machines to avoid environmental hazards.

The present invention therefore provides a compact image forming apparatus meeting such requirement, the characteristic point of which resides in the fact that the flow path of the discharge current of ozone gas and the flow path of the heated current from a heat source are ultimately contralized at one place within the reproduction machine, where the ozone filter is disposed so as to heat the ozone gas with such heated current, while they are passing through the filter, to thereby quickly decompose ozone, and give a cooling effect to the heat current. Thus, the ozone concentration does not create an environmental hazard and the gas is discharged in its cooled condition.

Figure 23:
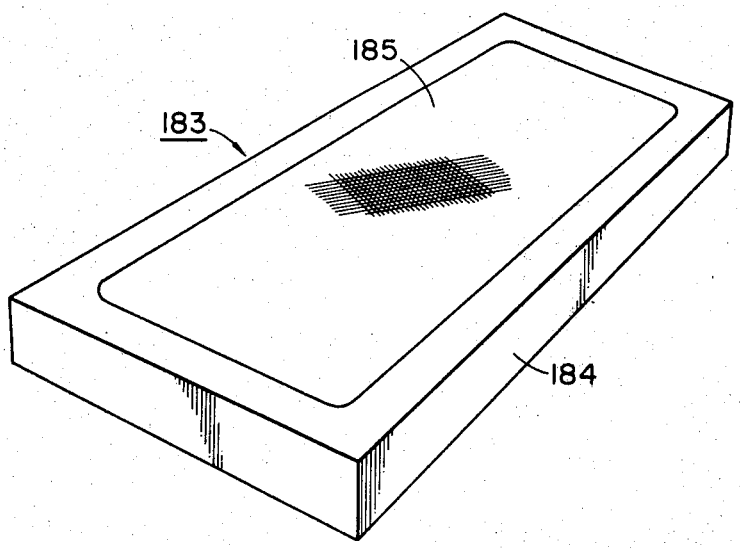
FIG. 23 is a perspective view of an ozone filter shown in FIG. 1.

Detailed construction of such device will be described hereinbelow in reference to FIGS. 1, 23 and 24.

The principal elements of the office copier shown in this embodiment are disposed in the following manner so as to solve the technical problems as mentioned above. Outline of this arrangement will be explained in reference to FIGS. 1 and 24.

The drum-shaped photosensitive member is disposed at a substantially center part of the apparatus to enable various component parts to be arranged therearound. In the illustrated embodiment of the apparatus, the corona discharge 17 for precharge-removing, the corona discharger 5 for the primary charging, the corona discharger 6 for the secondary charging or charge removing, the developing device 7, the corona discharger 10 for image transfer, the image transfer material separating roller 12, the cleaning device 16, and so forth are arranged around the photosensitive drum. In order to introduce the image original light from the image original mounting table onto the photosensitive drum 3 through the short focus lens array 4 with the shortest light path length, the corona discharger 6 for the secondary charging or charge-removing integral with the lens array 4 is disposed immediately above the photosensitive drum 3. Accordingly, with this position as the reference, each and every component element starting from the abovementioned developing device onward are arranged along the rotational direction of the photosensitive drum. According to this arrangement, the developing device 7 is disposed at one side and the cleaning device 16 is disposed on the other side along the vertical line passing through the center of the photosensitive drum.

Needless to say, the number of the abovementioned corona dischargers to be provided differs to some extent depending on the latent image forming process to be adopted. In the illustrated embodiment, the process as taught, for example, in U.S. Pat. No. 3,666,363 or No. 4,071,361 is adopted. It goes without saying that the latent image formation in accordance with the conventional Carlson process can be adopted. In that case, the corona discharger for the secondary discharging, for example, is not required, but the other corona dischargers are usually used. It is therefore unavoidable that ozone would generate from these corona dischargers.

The main heat sources in the reproduction apparatus are the halogen lamp 20 as the light source for use in the image exposure, pre-exposure, and post-exposure, and the halogen lamp 130 (in FIG. 16) in the fuser roller image fixing device. Besides these, transformers and other electrical parts generate heat. Of these heat sources, the halogen lamp 20 is disposed in the vicinity of the abovementioned image original mounting table for illuminating the original image, while the halogen lamp 130 is placed in the image fixing device which is away from the photosensitive drum.

In the present embodiment, an air intake fan 186 and an air exhaust blower 19 are provided on both upper end parts within the machine housing with the photosensitive drum positioned between them, as shown in FIG. 24, for the purpose of centralizing the flow path of the exhaust air current containing ozone gas therein and the flow path of the heated air current from this abovementioned heat sources. In this instance, the air intake fan 186 for supplying air to cool the light source is disposed at the side where the developing device is provided so as to send out air toward the upstream side to the developing device and the light source. In this case, a flow path is formed so that air may be discharged through the corona dischargers 6, 5 and 16, and at the same time, the air exhaust blower 19 is provided on the upper part of the image fixing device to perform the heat discharging operation from the halogen lamp 20 for the light source as well as the halogen lamp 130 for the image fixing. As shown in FIGS. 1 and 24, this air exhaust blower 19 is at the upper left hand of the main body housing. More specifically, it is disposed in a box-shaped space defined by the front and rear plates of the upper main body, a planar stay 180 to join these plates, and the upper cover 181.

In the planar stay 180, there is formed a cut-out 180*a* at a position corresponding to the outlet of the air discharging blower and an air intake port 182 at a position substantially above the image fixing device.

At the inlet side of the air discharging blower 19, there is attached an ozone filter 183 formed by, for example, activated carbon having a property of adsorbing ozone thereon. The ozone filter 183 covers the entire surface of the air intake flow path formed by the front and rear plates of the upper main body, the planar stay 180, and the upper cover 181. Ozone gas generating from the corona dischargers 17, 5, and 6 passes through the abovementioned ozone filter 183 along with air passing through the air intake flow path, during which adsorption of ozone is effected. The ozone filter 183 is constricted as shown in FIG. 23. That is, an ozone adsorptive substance such as activated carbon from coconut shell, charcoal, and others is filled in a shallow case made of a frame 184 and a meshing member 185 fixed thereto.

In place of such ozone adsorptive material, there may be used a ceramic base (e.g. $Al_2O_3$), on which a metal catalyst (e.g. one or more kinds selected from Pt, Ag, Ti, Cu, Ca, K, Zn, etc.) is calcined to decompose ozone. In the latter kind of the ozone filter, since no ozone adsorptive material is filled in the meshing member 185, it is possible to utilize the shape of the meshing member per se, hence air flow of the filter is improved.

The air discharging blower 19 is a sirocco fan of a two-side intake type, which has sufficient sucking force against pressure loss due to the ozone filter, hence a sufficient amount of air to cool the halogen lamp can be obtained.

The air to cool the halogen lamp and the optical system flows as shown in FIG. 24 from the right side to the left side of the reproduction apparatus through the air intake fan, the air discharging blower and the air flow paths between them. As described above, the developing device is provided at the upstream side of the halogen lamp as the heat source, hence fusion of the developer due to heat can be prevented by minimizing the temperature increase in the developer due to the halogen lamp.

Air containing highly concentrated ozone and flowing around each and every corona discharger cools the halogen lamp 20, is then mixed with heated air from the heat sources, and passes through the ozone filter 183, whereby ozone becomes effectively pyrolyzed in an extremely rapid manner. In addition, it has been observed that the ozone adsorbing capability of the activated carbon increases to effectively prolong its life, which effect is considerable since such temperature-increased state is maintained for a certain length of time.

According to the experiments done by the present inventors, when the ozone filter with approximately 120 g of coconut shell activated carbon filled within the frame of 280 $cm^2$ in area and 1.2 cm in thickness is used, an ozone concentration of 0.25 ppm at 65° C. at the point P (before ozone adsorption) in FIG. 24 is observed to lower to an ozone concentration of 0.01 ppm at the point Q (after the ozone adsorption). At this time, the air quantity passing through the ozone filter is 27 liters/sec.

In regard to the effect derived from heating, it has been found that the ozone adsorbing capability of the ozone filter can be maintained at 70% against its full capacity of 100% in its initial state prior to the experiment (the temperature in the ozone filter section being approx. 65° C.) with the halogen lamp 20 being lit. On the other hand, when the same experiment is conducted at a temperature of 20° C. and without lighting the halogen lamp 20, the ozone adsorbing capability of the filter lowers to 45% against its initial state. From this experiment, it is ascertained that the ozone adsorbing capability of the filter evidently decreases in comparison with its heated state.

From the air intake port 182 of the planar stay 180, surrounding air as heated by the image fixing device is discharged, thereby preventing the cleaning unit from raising its temperature and fusing the toner. Since no ozone is contained in this air, it need not be passed through the ozone filter.

It should be noted that the above-described embodiment is only for the convenience of explanation of the present invention, and that the present invention is not limited to this embodiment alone, but changes and modifications may be made within the ambit of the invention which falls under the scope of the invention as set forth in the appended claims.

What we claim is:

1. An image forming apparatus, comprising:

a rotatable photosensitive member in a housing;

a short focus image forming element array for exposure provided above said photosensitive member;

image transfer means disposed beneath said photosensitive member;

developing means provided on one side between said image forming element array and said image transfer means;

cleaning means provided on the other side between said image forming element array and said image transfer means, said cleaning means being disposed in contact with said photosensitive member, for removing the residual developer from the image bearing member;

guiding means, disposed upstream of the contact between said cleaning means and the photosensitive member with respect to movement of the photosensitive member, for guiding the developer removed from the member away from the surface thereof;

a stopper member, mounted to a side of said cleaning means which is remote from the photosensitive member, for stopping the leading edge of the transfer material which incidentally comes to said cleaning member; and an ozone filter provided at the side of said cleaning means.

2. An apparatus according to claim 1, further comprising a cleaner housing having said cleaning means disposed therein and having an opening facing said photosensitive member adjacent the contact between said cleaning means and the photosensitive member, wherein said cleaning means includes a cleaning blade.

3. Apparatus according to claim 2, wherein said stopper means is integrally mounted to the backside of the cleaning blade.

4. An image forming apparatus wherein a developed image is formed on a surface of a movable image bearing member, and then transferred to a transfer material, whereafter the residual developer remaining on the image bearing member after the image transfer is removed to allow repeated use of the image bearing member, comprising:

a cleaning member, contacted to said image bearing member, for removing the residual developer from the image bearing member;

guiding means, disposed upstream of the contact between said cleaning member and the image bearing member with respect to movement of the image bearing member, for guiding the developer removed from the image bearing member away from the surface of said image bearing member; and stopper means, mounted to a side of said cleaning member which is remote from the image bearing member, for stopping the leading edge of the transfer material which incidentally comes to said cleaning member.

5. An apparatus according to claim 4, further comprising a housing having said cleaning member disposed therein and having an opening facing said image bearing member adjacent the contact between said cleaning member and the image bearing member, wherein said cleaning member includes a cleaning blade.

6. An apparatus according to claim 5, wherein said stopper means is integrally mounted to the backside of the cleaning blade.

* * * * *

UNITED STATES PATENT AND TRADEMARK OFFICE

CERTIFICATE OF CORRECTION

PATENT NO. : 4,401,385

DATED : August 30, 1983

INVENTOR(S) : HAJIME KATAYAMA, ET AL.

It is certified that error appears in the above-identified patent and that said Letters Patent is hereby corrected as shown below:

Col. 1, line 24, change "zone to generate" to read --ozone which is generated--;

line 26, change "hologen" to --halogen--.

Col. 5, line 65, change "moving" to --move--;

line 67, change "moving" to --move--.

Col. 7, line 14, after "interfere" insert --with--;

line 15, change "and" to --end--.

Col. 8, line 12, between "as" and "front" insert --well as--.

Col. 9, line 23, change "fed" to --led--.

Col. 12, line 41, change "pressurize" to --pressure--.

Col. 13, lines 24-25, change "silicon-oil" to --silicone oil--;

UNITED STATES PATENT AND TRADEMARK OFFICE

CERTIFICATE OF CORRECTION

PATENT NO. : 4,401,385

DATED : August 30, 1983

INVENTOR(S) : HAJIME KATAYAMA, ET AL.

It is certified that error appears in the above-identified patent and that said Letters Patent is hereby corrected as shown below:

Col. 13 (cont'd)

line 33, before "facilitate" insert --to--;

line 62, change "read" to --reed--.

Col. 18, line 16, after "much" insert --the--;

line 24, change "varying" to --copying--;

line 31, change "contralized" to --centralized--.

Col. 19, line 66, change "constricted" to --constructed--.

Signed and Sealed this

*Fourteenth* Day of *February 1984*

[SEAL]

*Attest:*

GERALD J. MOSSINGHOFF

*Attesting Officer*

*Commissioner of Patents and Trademarks*